United States Patent [19]

Podell et al.

[11] 4,011,528

[45] Mar. 8, 1977

[54] SEMI-LUMPED ELEMENT COUPLER

[75] Inventors: Allen F. Podell, Los Altos, Calif.; Leo Young, Bethesda, Md.; Arthur Karp, Palo Alto; Donald R. Chambers, Menlo Park, both of Calif.

[73] Assignee: Stanford Research Institute, Menlo Park, Calif.

[22] Filed: July 14, 1975

[21] Appl. No.: 595,395

[52] U.S. Cl. ..... 333/10; 333/84 M

[51] Int. Cl.[2] ..... H01P 5/18

[58] Field of Search ..... 333/10, 84 M

[56] References Cited

UNITED STATES PATENTS

| | | | |
|---|---|---|---|
| 3,167,727 | 1/1965 | Lunden et al. | 333/10 X |
| 3,544,921 | 12/1970 | Winston et al. | 333/10 X |
| 3,593,208 | 7/1971 | Smith | 333/10 |
| 3,904,991 | 9/1975 | Ishii et al. | 333/10 |

*Primary Examiner*—Paul L. Gensler
*Attorney, Agent, or Firm*—Lindenberg, Freilich, Wasserman, Rosen & Fernandez

[57] ABSTRACT

A coupling circuit for use at microwave frequencies comprising two conductors each having substantially the shape of a W, which conductors are deposited on a substrate in a manner so that the bases of W's oppose one another to form two semi-lumped capacitances of different susceptance, separated by phasing line lengths.

5 Claims, 4 Drawing Figures

Fig. 1
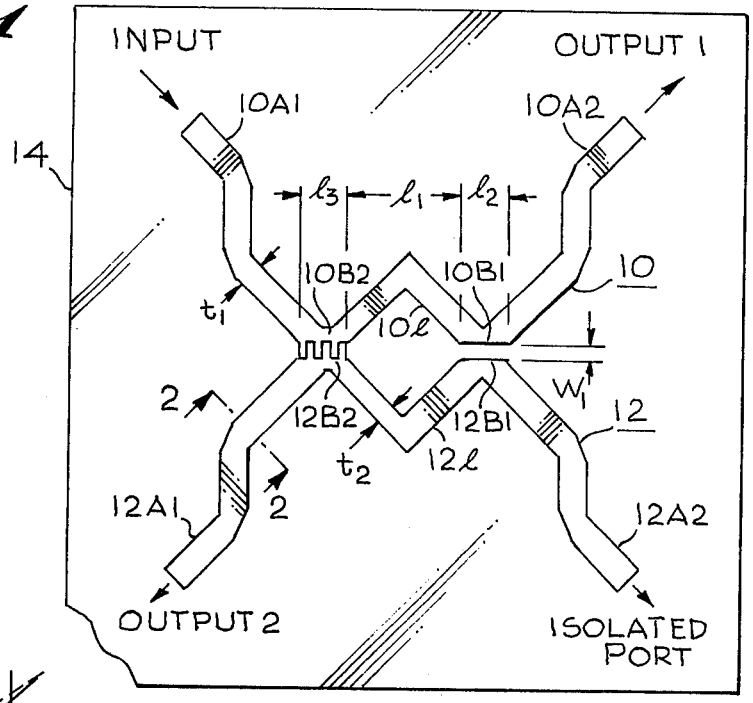
Fig. 4
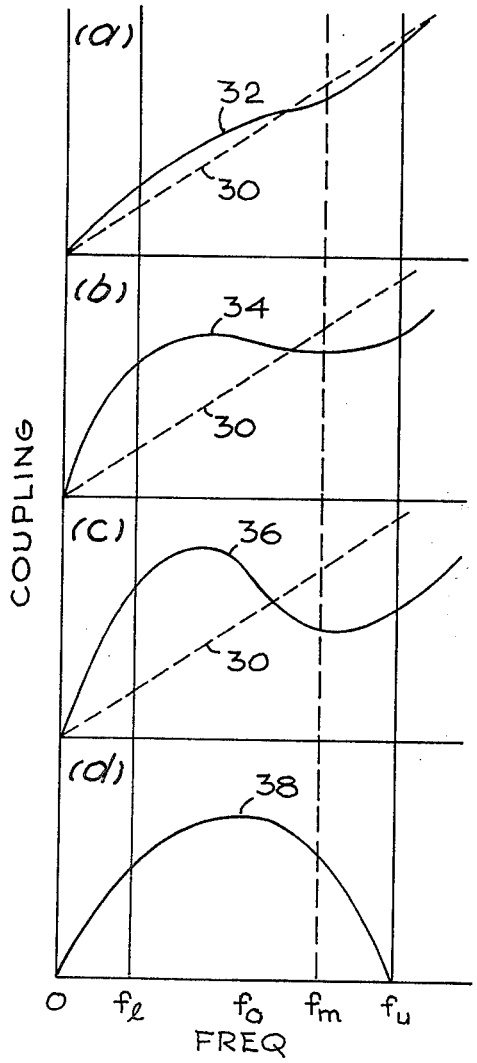
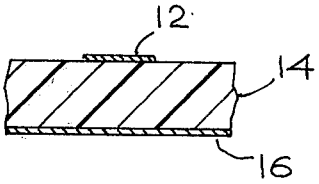
Fig. 2
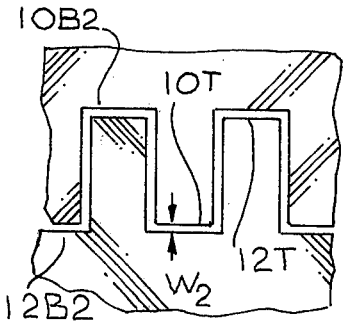
Fig. 3

SEMI-LUMPED ELEMENT COUPLER

BACKGROUND OF THE INVENTION

This invention relates to directional coupling circuits, suitable for use at microwave frequencies, and more particularly to improvements therein.

One of the concerns of all directional couplers, toward the solution of which a great deal of effort has been made, is the issue of "ripple bandwidth." This is a figure of merit which is used to measure the uniformity of transmission across the operative bandwidth of the coupler. Obviously it is desirable to have signals at all of the frequencies within the bandwidth for which the coupler is to be used, passed therethrough without variation. However, the ideal situation has not been achieved thus far.

OBJECTS AND SUMMARY OF THE INVENTION

An object of this invention is to provide a microwave coupler element which has an improved ripple bandwidth.

Yet another object of the present invention is to provide a novel, simple and relatively inexpensive microwave coupling element.

The foregoing and other objects of this invention are achieved by depositing, on one surface of an insulating substrate, what may be termed a semi-lumped coupler element comprising two conductors, each of which is given a substantially W shape. The bases of the W's are deposited in a manner to oppose one another, whereby lumped capacitive susceptance elements are formed at the regions of the bases. The susceptances are determinable, either by the spacing or by the dimensions of the opposing conductor sections or by using "interdigital fingers" at one of the opposing regions of the conductors. The lengths of the conductor between the capacitances are phasing line lengths. While the embodiment of the invention is described as two opposing W shaped conductors, it should be appreciated that this concept can be extended to include a multiplicity of capacitors each separated from its neighbor by a phasing line length.

The novel features of the invention are set forth with particularity in the appended claims. The invention will best be understood from the following description when read in conjunction with the accompanying drawings.

BRIEF DESCRIPTION OF THE DRAWINGS

FIG. 1 is a plan view of the embodiment of the invention.

FIG. 2 is a partial cross-sectional view of the invention along the lines 2—2.

FIG. 3 is an enlarged section illustrating the interdigital finger arangement of the embodiment of the invention.

FIG. 4 are a series of curves illustrating the coupling versus frequency characteristics of three embodiments of the invention as compared with the characteristics of a conventional parallel line coupler.

DESCRIPTION OF THE PREFERRED EMBODIMENTS

Referring now to FIGS. 1 and 2, a coupler, in accordance with this invention, comprises a first conductor 10 and a second conductor 12 deposited on the substrate 14. The opposite surface of the substrate to the one on which the conductors are deposited is coated with conductive material 16.

The two conductors, respectively 10, 12, are each shaped substantially in the form of a W having their bases respectively 10B1, 12B1, and 10B2, 12B2, spaced from and opposing one another. Because of the proximity of the opposed conductors at the bases of the W's, as is well known, capacitive susceptances are formed which are determinable in accordance with the spacing and area of the opposed conductors according to well known formulas.

In addition to establishing at least two capacitors in the manner described, the conductor lengths 10l, 12l, between the capacitors determines the phase difference over this region. One of the arms, 10Al of the W shaped conductor 10 serves as an input to the coupler and the other arm, 10A2 is an output. One of the arms 12A1 of the conductor 12 serves as an output, wherein the output is approximately −20db down from the input. The other arm 12A2, serves as an isolated port. It will be appreciated that the structure shown is reciprocal and the inputs and outputs of the conductor 10 can be interchanged with the output and isolated port of the conductor 12.

The coupler is designed to have one small capacitance, such as the one formed by the opposing conductor segments 10B1, 12B1 and a larger capacitance such as is formed by the conductor segments 10B2, 12B2. The large capacitor may be formed by having two flat opposed surfaces at the region at the base of the W and thus will have the appearance of the small capacitance established in the regions 10B1, 12B1, except for a narrower gap. However, it has been found desirable to increase the larger susceptance while maintaining the dimensions of the bases of the W's in this region, as substantially the same. This is done in the manner represented at the region 10B2, 12B2 where there is illustrated interdigital fingers, which are shown in enlarged form in FIG. 3. These merely comprise effectively two combs with the teeth of one comb, represented by 10T inserted into a space between the teeth, represented by 12T, in the other comb.

By way of illustration, but not to serve as a limitation on the invention, the dimensions of a coupler, designed for a mid-band frequency of 510 MHZ will be provided. The coupler can be scaled to any frequency by adjusting all of the dimensions according to the following ration, $X' = X \times 510/f'$, where $X'$ is the new dimension, X is the dimension to be given below, and $f'$ is the new frequency in MHZ.

As shown in FIG. 3, the spacing $W_2$ between the interdigital fingers is 0.045 inch and the width, $l_3$, of the region established between 10B2 and 12B2 is on the order of 6/16 of an inch. A dimension $l_2$ of the region established between 10B1 and 12B1 is on the order of 6/16 of an inch also. The angles between adjacent sides of the W's on FIG. 1 is 90°. The distance $l_1$, which is the phasing distance between the two base portions of the oppposing W's, is 1.117 inches. Accordingly, the length of each segment of the two segments forming the second portion of the W is on the order of 0.747 inches. The width $t_1$ of the conductor 10 is 0.25 inches, and the width $t_2$ of the conductor 12 is 0.183 inches. The spacing between 10B1 and 12B1, equals $W_1$, equals 0.135 inches. The length of the radial arms of the W's are as long as is required to make the connection to the input or output circuits. The thickness of the dielectric is ¼ inch and the relative dielectric constant of the dielectric is 10.

The operation of the "W" coupler, which is the coupler being described herein, can be explained in terms of the conventional theory of even-and odd-modes. However, unlike the case of conventional parallel-line couplers, reflections are not caused by impedence steps, but rather by shunt capacitances for the odd mode, and their duals, are the series inductances, for the even mode.

The even mode reflection coefficient for either the W coupler of the parallel-line coupler is the negative of the odd mode reflection coefficient; hence they cancel in the input arm 10A1 and the coupler as a whole is reflectionless. However, in the backward coupled arm, 12A1, the even-and odd-mode inputs are out of phase, since there is no actual input there; hence, their reflective components add up (since two negatives make a positive), thus explaining the backward coupling of these couplers. Even-and odd-mode reflection coefficients are of opposite sign because the even- and odd-mode prototype circuits are duals of each other for both the W coupler and the conventional quarter wave parallel-line coupler.

Coupling is a function of the reflection from each discontinuity, be it impedance step or shunt capacitance. In the case of the shunt capacitance, the reflection coefficient of each capacitance increases with frequency, (since the susceptance increases with frequency). Principal reflection is due to the larger capacitance, here established by the interdigital fingers 10T, 12T. If the smaller capacitance were 0, then the reflection coefficient and therefore the coupling factor, (for a weak coupler), would increase nearly linearly with frequency. The small capacitance, in the embodiment of the invention, is spaced ¼ wave length away at some frequency $f_m$ greater than the midband frequency, $f_0$, but less than the upper band edge frequency $f_u$. The reflection from the small capacitance subtracts from that of the large capacitance at $f_m$, but as the electrical spacing departs from 90°, the two reflections, (from the large capacitance and from the small capacitance respectively) are no longer 180° out of phase. (For example, at the band edges they will be almost in quadrature.) Thus, at the band edges the small capacitance has less effect on the total reflection coefficient.

The effect of the small capacitance may be seen in the curves shown in FIG. 4. The curves shown illustrate a variation in coupling as a function of frequency. The dashed straight lines, 30, shown superimposed on each one of the curves corresponds to the case where the small capacitance value is 0, (that is when there is only one discontinuity). The solid curves respectively 32, 34, and 36 indicate the composite responses due to two capacitors.

The curve 32 represents the situation when the small capacitance is smaller than optimum, and the curve 36 represents the situation when the smaller capacitance is larger than optimum, while the curve 34 represents the situation in which the smaller capacitance is just right, since it results in an "equal ripple" coupling over the range from lower band edge $f_l$ to the upper band edge $f_u$. At the frequency $f_m$, the reflections from the two capacitor discontinuities are 180° out of phase, therefore the minima for curves 32, 34, and 36, is close to $f_m$.

For comparison, curve 38 is shown which represents the coupling for a conventional parallel-line coupler, ¼ wave length long at frequency $f_O$. The mid band frequency, $f_O$ equals $(f_l+f_u)/2$, which is less than $f_m$. The curve is symmetrical about $f_O$, yielding equal couplings at $f_l$ and $f_u$.

The "W" coupler has a greater ripple bandwidth than the single section quarter wave coupler, as indicated by comparing the curves 34 and 38. The curve 34 is cubic whereas the curve 38 has the appearance of a quadratic. Thus, the curve 34 passes through three points of identical coupling while the curve 38 has only two such points. Therefore the coupling characteristic of the "W" coupler has inherently less ripple in the pass band than the conventional single-section coupler.

There has accordingly been described and shown herein a novel, useful and improved coupler for use at microwave frequencies.

The embodiments of the invention in which an exclusive property or privilege is claimed are defined as follows:

1. A microwave coupler comprising a dielectric substrate, a first conductor substantially in the form of a W deposited on said substrate, a second conductor substantially in the form of a W which is substantially a mirror image of the first conductor deposited on said substrate with the two base sections of said second conductor W capacitively spaced opposite the two base sections of the W formed by said first conductor, and a conductive coating deposited on the opposite side of said substrate.

2. A coupler as recited in claim 1 wherein each of the angles established by forming the first and second conductors into the shape of a W is 90°.

3. A coupler as recited in claim 1 wherein one of the opposing base sections of the W's formed by said first and second conductors are flat for establishing capacitive coupling therebetween.

4. A coupler as recited in claim 1 wherein one of the opposing base sections of said first and second conductors are formed into spaced interleaving fingers to establish a capacitor therebetween.

5. A microwave coupling circuit comprising a substrate, a conductive coating deposited on one side of said substrate, a first conductor shaped to form a W, deposited on the other surface of said substrate, a second conductor shaped to form a W which is substantially a mirror image of the first conductor deposited on said other surface of said substrate with its two base regions opposite the base regions of the W formed by said first conductor, one of the base regions of said first and second conductors being formed flat and spaced from one another to provide a first capacitance, the other base regions of said first and second conductors formed into fingers which are spaced from and interleaved with one another to form a second capacitor, and the lengths of the first and second conductor segments, which extend between the base regions of said W shaped first and second conductors, being predetermined to provide a predetermined phasing.

* * * * *